US005207607A

United States Patent [19]

Nagano et al.

[11] Patent Number: 5,207,607

[45] Date of Patent: May 4, 1993

[54] PLASMA DISPLAY PANEL AND A PROCESS FOR PRODUCING THE SAME

[75] Inventors: Shinichirou Nagano; Takashi Yamanaka; Osamu Uchiyama, all of Hyogo, Japan

[73] Assignee: Mitsubishi Denki Kabushiki Kaisha, Tokyo, Japan

[21] Appl. No.: 627,466

[22] Filed: Dec. 14, 1990

[30] Foreign Application Priority Data

Apr. 11, 1990 [JP] Japan ..... 2-95581
Aug. 29, 1990 [JP] Japan ..... 2-227395

[51] Int. Cl.[5] ..... H01J 9/26

[52] U.S. Cl. ..... 445/25; 313/582; 313/634; 445/43

[58] Field of Search ..... 313/493, 634, 582; 445/25, 43

[56] References Cited

U.S. PATENT DOCUMENTS

| | | | |
|---|---|---|---|
| 2,694,273 | 11/1954 | Spyut | 445/43 |
| 3,778,126 | 12/1973 | Wilson | 445/25 |
| 3,914,000 | 10/1975 | Beckerman et al. | 445/25 |
| 4,029,371 | 6/1977 | Kupsky | 445/25 |
| 4,182,540 | 1/1980 | Frankland et al. | 445/25 |
| 4,204,721 | 5/1980 | Hubert et al. | 445/25 |

FOREIGN PATENT DOCUMENTS

| | | |
|---|---|---|
| 0031921 | 7/1981 | European Pat. Off. . |
| 55-150523 | 11/1980 | Japan . |
| 60-218737 | 11/1985 | Japan . |

OTHER PUBLICATIONS

J. B. Shapiro, IBM Technical Disclosure Bulletin, "Multiple Processed, Tubeless Gas Display Panels", vol. 24, No. 7B, Dec. 1981, pp. 3899-3900.

IBM Technical Disclosure Bulletin, "Addition of Weight-Absorbing Modules to Quad Seal Fixtures", vol. 28, No. 7, Dec. 1985, pp. 2774-2776.

*Primary Examiner*—Donald J. Yusko
*Assistant Examiner*—Andrew Hill
*Attorney, Agent, or Firm*—Rothwell, Figg, Ernst & Kurz

[57] ABSTRACT

An enclosure defined between two panel members is filled with a discharge gas. One of the panel members carries a sealing material surrounding the enclosure and has an evacuating and gas-filling port, while the other panel member carries a port blocking member formed in an appropriate positional relation to the port. The whole is heated, so that the sealing material may soften and join the panel members to each other along the edges thereof and form a gas-tight seal therebetween, while the blocking member also softens to close the port. The softened blocking member stays within the enclosure and the port. Nothing projects from either of the panel members at any angle thereto. A strong plasma display panel having only a minimum thickness as required can, therefore, be realized. If the joining of the panel members and the closing of the port are simultaneously carried out, the panel can be made quickly and at a low cost. The closing of the port can alternatively be done after the joining of the panel members.

1 Claim, 6 Drawing Sheets

PLASMA DISPLAY PANEL AND A PROCESS FOR PRODUCING THE SAME

BACKGROUND OF THE INVENTION

1. Field of the Invention

This invention relates to a plasma display panel which relies upon a gas discharge for the display of an image and a process for producing such a panel.

2. Description of the Prior Art

FIGS. 1 and 2 of the accompanying drawings are top plan and sectional views, respectively, showing the arrangement, prior to assembly, of various parts of a known plasma display panel as disclosed, for example, in the Japanese patent application laid open under No. 150523/1980. The panel includes a back panel member 1 provided with cathodes, not shown, as discharge electrodes, and formed therethrough with a gas port 2. It also includes a front panel member 3 provided with anodes 4 as discharge electrodes which are isolated from one another by insulating partitions 5. The back panel member 1 carries a deposit of glass 6 which is used for joining the back and front panel members 1 and 3 along the edges thereof and forming a seal therebetween. A glass tube 7 is connected to the port 2 for introducing a gas into the plasma display panel as assembled, or removing it therefrom. A deposit of glass 8 is used for joining the glass tube 7 to the back panel member 1 and forming a seal between the port 2 and the adjacent end of the tube 7. The back and front panel members 1 and 3 and the glass 6 define a vacuum enclosure when the panel is assembled.

The deposits of glass 6 and 8 are melted by heating for joining the back and front panel members 1 and 3, and the back panel member 1 and the glass tube 7, respectively, in a sealed way, as shown in FIG. 3. The inside of the assembly is filled with a gas 9, and the glass tube 7 is melted and cut by e.g. a gas burner to form a closure 10, whereby the gas 9 is isolated from the atmosphere, as shown in FIG. 4.

Referring in further detail to the process as hereinabove described, the deposits of glass 6 and 8 as shown in FIG. 2 are first softened by heating. The softened glass 6 is deformed by the weight of the back panel member 1 or an external force applied to it until the back panel member 1 contacts the insulating partitions 5 and has a smaller distance from the front panel member 3. The glass 6, as well as the glass 8, is cooled to ambient temperature, and thereby solidified, whereupon a sealed assembly is formed, as shown in FIG. 3. Then, the inside space of the assembly as defined between the back and front panel members 1 and 3 is evacuated through the glass tube 7 and the gas 9 is introduced into the space through the tube 7. Finally, the closure 10 is formed on the glass tube 7, whereupon the plasma display panel is assembled, as shown in FIG. 4.

The conventional panel as hereinabove described, however, has a part of the glass tube 7 remaining on the back panel member 1, as shown in FIG. 4. The length of the remaining part of the glass tube 7 adds to the thickness of the panel and renders it impossible to make any panel having a smaller overall thickness. The glass tube 7 projecting from the back panel member 1 not only calls for special care to be taken to protect the glass tube 7 against any shock, but also makes the panel as a whole so bulky that inconveniences may be encountered in the handling, packing or transportation of the panel which is being assembled, or has been assembled.

FIG. 5 illustrates a process proposed for improving the problems as hereinabove pointed out. This process does not employ any glass tube as shown at 7 in FIGS. 1 to 4. According to this process, a back panel member 1 and a front panel member 3 are joined to each other by glass 6 forming a seal therebetween, and a ring 11 of low-melting glass is deposited on the outer surface of the back panel member 1 coaxially with a gas port 2. A closing plate 13 carrying a deposit of low-melting glass 12 is placed on the ring 11, so that the glass 12 may lie between the ring 11 and the plate 13, and the plate 13 is held against the ring 11 by a clip, or like jig 14. The glass 12 has pores 15 which maintain fluid communication between the inside and outside of a panel defined by the back and front panel members 1 and 3. The panel is placed in a vacuum tank and is subjected to evacuation and degassing until a vacuum degree of $10^{-7}$ torr is reached in the inside of the panel. Then, a discharge gas is introduced into the tank to fill the inside of the panel. Finally, the whole assembly is heated, so that the low-melting glass 11 and 12 may be softened and fused together to form a seal closing the port 2.

The closing plate 13, however, remains projecting from the back panel member 1 and its thickness adds to the overall thickness of the plasma display panel. Therefore, the proposed process is not a satisfactory solution to the problems as hereinbefore pointed out, including the inconveniences in handling, and the bulkiness of the panel. Accordingly, it has been proposed that the closing plate 13 be fitted in a recess formed in the outer surface of the back panel member 1 along the edge of the port 2. The maintenance of satisfactory strength in the recessed portion of the back panel member 1, however, calls for an increase in thickness of the back panel member 1. This increase is contrary to the desire to reduce the thickness of the panel as a whole and brings about an increase in weight thereof.

SUMMARY OF THE INVENTION

Under these circumstances, it is an object of this invention to provide a plasma display panel which is sufficiently small in thickness to be easily packed, or otherwise handled.

It is another object of this invention to provide a process which can produce a plasma display panel easily, particularly after a sealed assembly of panel members has been completed.

It is still another object of this invention to provide a process which can produce a plasma display panel quickly at a low cost.

According to one aspect of this invention, there is provided a plasma display panel which comprises two parallel and spaced apart panel members joined to each other along the edges thereof by a sealing material forming a gas-tight seal therebetween, the panel members and the sealing material defining an enclosure filled with a discharge gas introduced thereinto through at least one port formed in one of the panel members, and a blocking member situated within the enclosure, joined to the other of the panel members, and closing the port in a gas-tight fashion.

The blocking member is situated between the two panel members and does not have any portion projecting outwardly from the panel. Therefore, the panel has a small thickness which is exactly equal to the sum of the thicknesses of the two panel members and the distance therebetween. Moreover, the blocking member contributes also to reinforcing the panel.

According to another aspect of this invention, there is provided a process for making a plasma display panel which comprises the steps of placing a first panel member and a second panel member in a parallel and spaced apart relation to each other, one of the panel members carrying along its edges a sealing material situated between the panel members and contacting the other of the panel members, so that the panel members and the sealing material may define an enclosure, while at least one blocking member which one of the panel members carries on its surface facing the inside of the enclosure is passed through at least one port extending through the other of the panel members and maintaining fluid communication between the inside and outside of the enclosure, evacuating the enclosure through the port, introducing a discharge gas into the enclosure through the port, and heating the whole, so that the sealing material may join the panel members along the edges thereof and form a gas-tight seal therebetween, while the blocking member closes the port in a gas-tight fashion.

This process makes it possible to assemble the panel quickly and at a low cost, since it accomplishes the joining of the two panel members and the closing of port simultaneously.

A modified form of the process is characterized by employing a blocking member having a height which is smaller than that of the sealing material, and which is larger than the prospective final distance between the two panel members. The blocking member faces the port when the enclosure is defined by the two panel members and the sealing material. After the enclosure has been evacuated and filed with a discharge gas, the whole is heated, so that the sealing material may join the panel members, and so that the blocking member may close the port simultaneously. The joined assembly of the panel members is easier to handle when the port is subsequently closed.

The above and further objects and novel features of the invention will more fully appear from the following detailed description when the same is read in connection with the accompanying drawing. It is to be expressly understood, however, that the drawings are for purpose of illustration only and are not intended as a definition of the invention.

DESCRIPTION OF THE PREFERRED EMBODIMENTS

A preferred embodiment of the invention will now be described in detail referring to the accompanying drawings.

Figure 1:
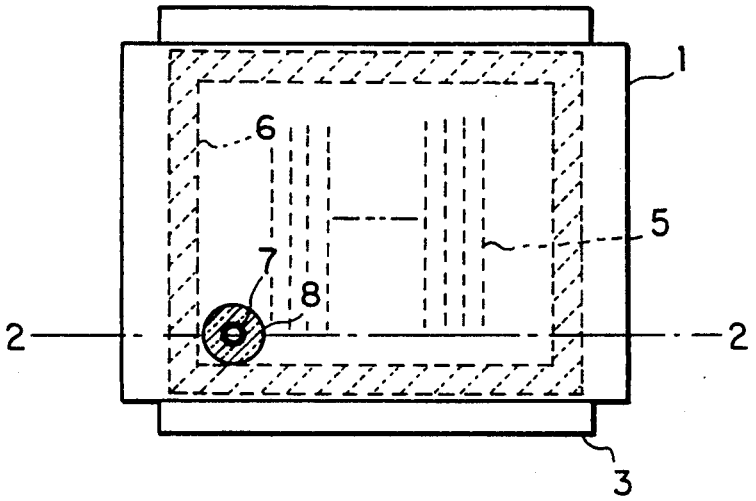
FIG. 1 (PRIOR ART)
FIG. 1 is a plan view illustrating a conventional plasma display panel.
Figure 2:
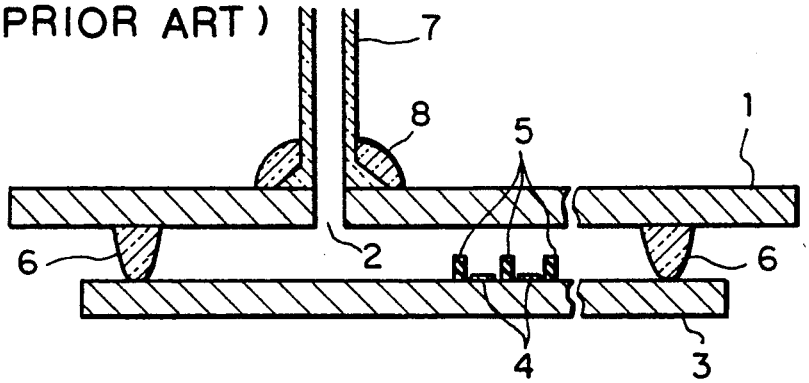
FIG. 2 (PRIOR ART)
FIG. 2 is a sectional view taken along the line 2—2 of FIG. 1.
Figure 3:
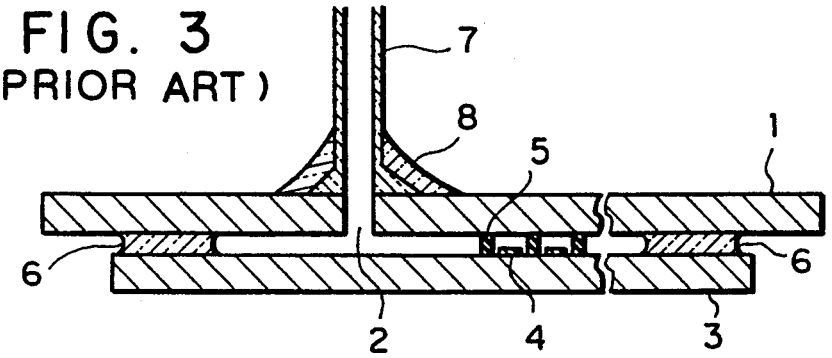
FIG. 3 (PRIOR ART)
FIGS. 3 and 4 are sectional views illustrating the process for assembling the panel shown in FIG. 2 in its form prior to assembly.
Figure 4:
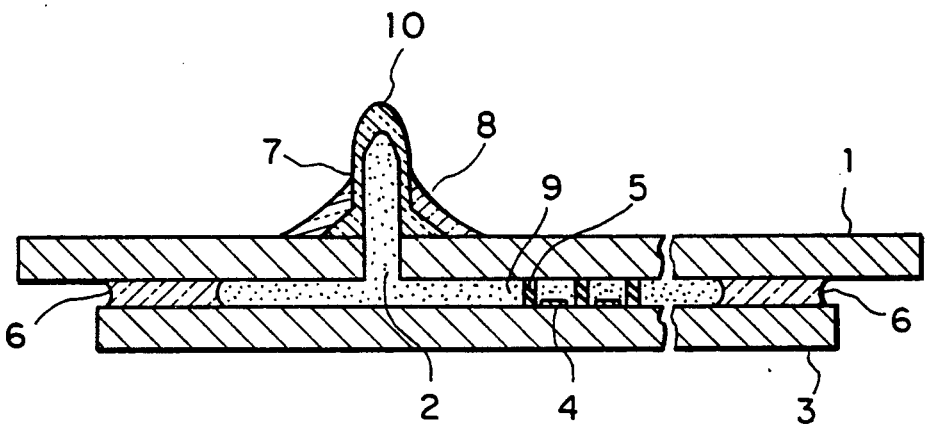
FIG. 4 (PRIOR ART)
Figure 5:
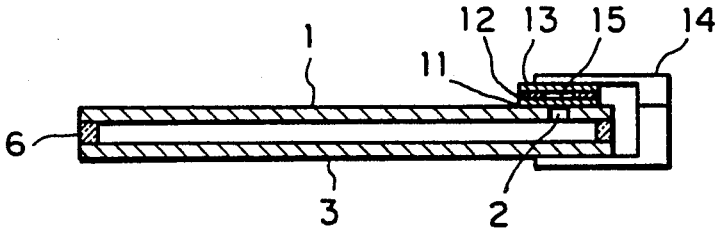
FIG. 5 (PRIOR ART)
FIG. 5 is a sectional view illustrating another conventional process for producing a plasma display panel.
Figure 6:
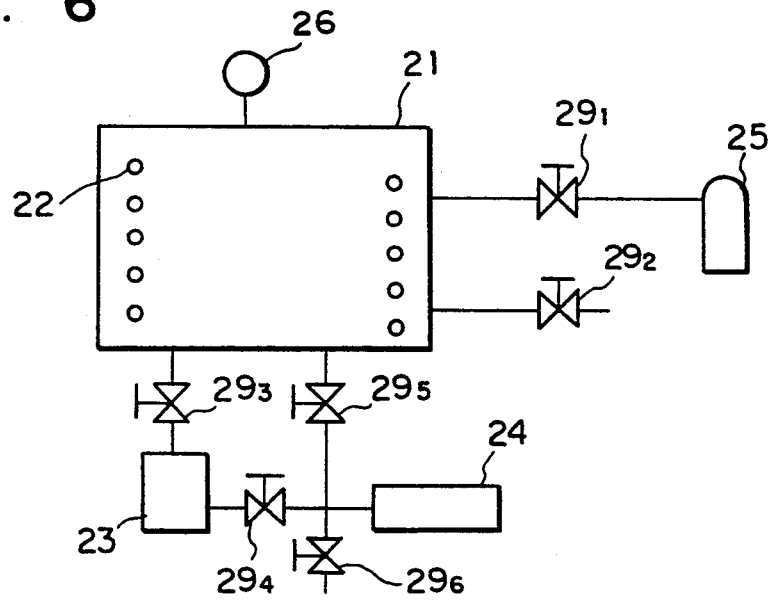
FIG. 6 is a schematic diagram of an evacuating and gas introducing apparatus which can be used for carrying out this invention.
Figure 7:
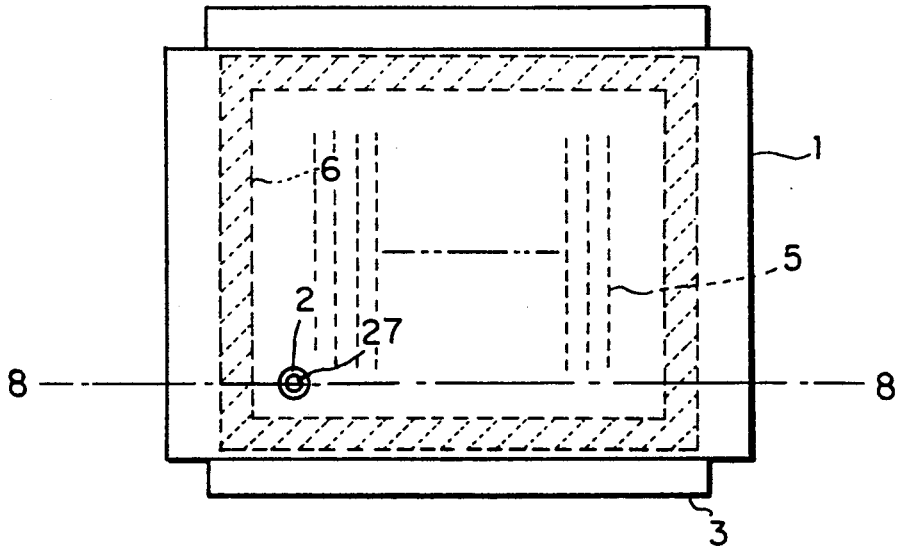
FIG. 7 is a top plan view of a plasma display panel embodying this invention.

Reference is first made to FIG. 6 showing diagrammatically an evacuating and gas introducing system which can be used for producing a plasma display panel in accordance with this invention. It comprises a vacuum tank 21, an electric heater 22, an oil diffusion pump 23, a rotary oil pump 24, a bottle 25 containing a discharge gas, a pressure gauge 26, and valves $29_1$ to $29_6$.

A process embodying this invention is shown in FIGS. 7 to 10. The same numerals are used in both FIGS. 1 to 4 and FIGS. 7 to 10 to indicate the equivalent parts and no description of those parts will be repeated. The numeral 27 which newly appears in FIGS. 7 to 10 denotes a blocking member in the form of a rod of low-melting glass which softens at a temperature of 430° C.

Figure 8:
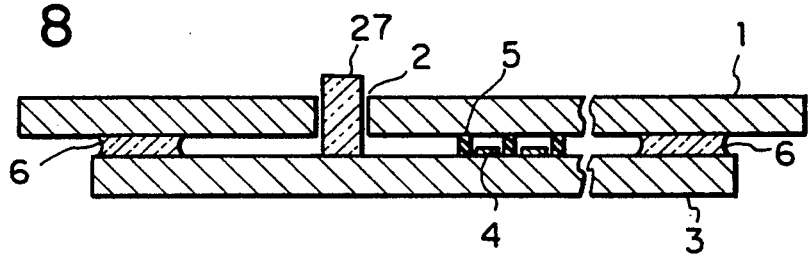
FIGS. 8 to 10 are sectional views taken along the line 8—8 of FIG. 7 and illustrating a series of steps of a process embodying this invention.

Glass 6 as a sealing material is softened by heating to join a first or back panel member 1 and a second or front panel member 3 along the edges thereof, and after it has been allowed to cool, the blocking rod 27 is inserted into a gas port 2, as shown in FIG. 8. The blocking rod 27 may, for example, have a diameter of 3.5 mm and a height or length of 3.0 mm when the back and front panel members 1 and 3 have a thickness of 1.8 mm each and a distance of 0.2 mm therebetween and the port 2 has a diameter of 4.0 mm, all by way of example.

Figure 9:
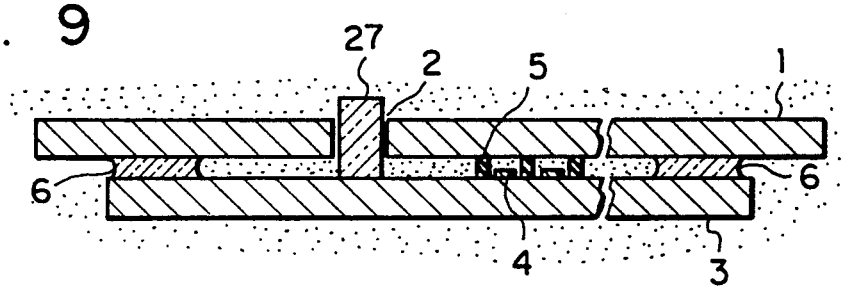

The assembly made as shown in FIG. 8 is placed in the vacuum tank 21. The tank 21 is evacuated and the heater 22 is simultaneously turned on to heat the assembly to a temperature of about 350° C. for degassing it. As the blocking rod 27 remains undeformed at that level of temperature, the gas existing in the assembly can be removed through the port 2. When a vacuum degree of $10^{-7}$ torr has been reached, the evacuation is discontinued and a discharge gas is introduced into the tank 21 to fill the assembly, as shown in FIG. 9.

Figure 10:
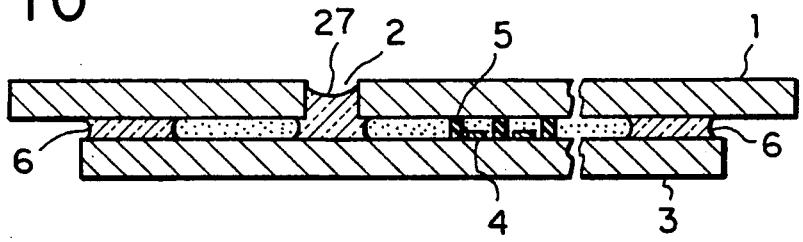

If the assembly is, then, heated to a temperature of 460° C., the blocking rod 27 softens and starts to undergo deformation by virtue of its own surface tension. As it is deformed, the blocking rod 27 contacts the peripheral wall of the port 2 and the interfacial tension which occurs between the softened material of the rod 27 and the wall of the port 2 causes the diffusion of the softened material into the port 2 until it finally closes the port 2, as shown in FIG. 10. Then, the tank 21 as a whole is cooled to allow the blocking rod 27 to solidify in its deformed shape as shown in FIG. 10, whereupon a plasma display panel filled with the discharge gas is obtained. When it has been cooled to normal temperature, the panel is removed from the tank 21.

Figure 11:
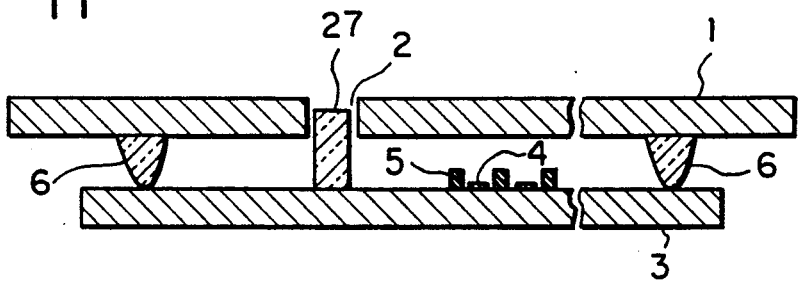
FIGS. 11 to 14 are view illustrating a process according to another embodiment of this invention.
Figure 12:
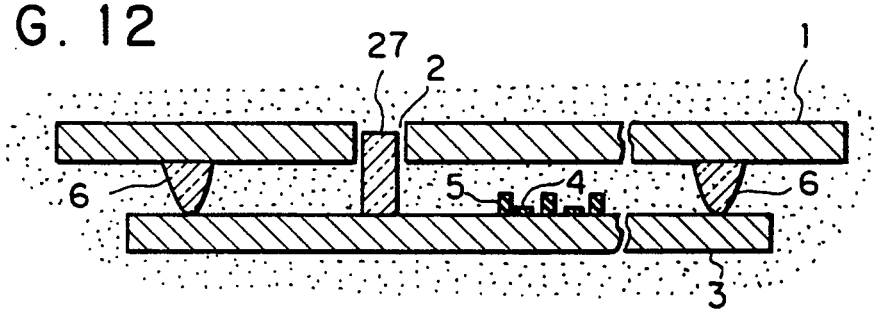

According to the process which has been described, the back and front panel members 1 and 3 are joined by the softened glass 6 before the assembly is placed in the vacuum tank 21. A modified process is shown in FIGS. 11 to 14. According to the modified process, two panel members 1 and 3 are placed in the vacuum tank 21 before they are joined to each other, as shown in FIG. 11. After evacuation and degassing at a temperature of 350° C., the enclosure is filled with a discharge gas, as shown in FIG. 12, as is the case with the process which has hereinabove been described. Then, the temperature of the tank 21 is raised to about 430° C. to soften glass 6. The softened glass 6 is deformed or flattened by the weight of the back panel member 1, or an external force applied to it, and the back and front panel members 1 and 3 have a smaller distance therebetween. This means a reduction in volume of the enclosure which would bring about an elevation in pressure of the discharge gas in the enclosure if the enclosure were closed.

Figure 13:
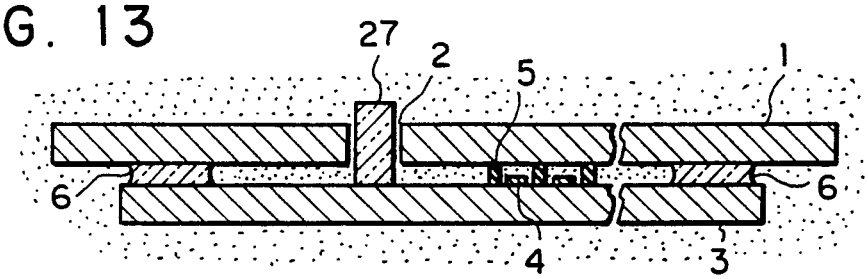
Figure 14:
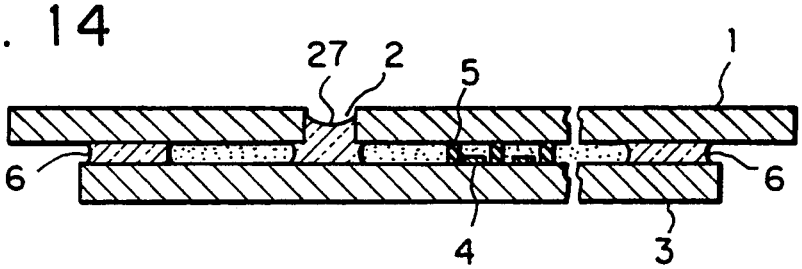

Although the tank temperature is already high enough to cause a blocking rod 27 to soften, the softened material still has so high a surface tension that no diffusion thereof in port 2 occurs. The port 2 still remains open and allows a balance of gas pressure to be maintained between the inside and outside of the enclosure. The softened glass 6 is, thus, flattened until the back panel member 1 contacts insulating partitions 5, as shown in FIG. 13. Then, the tank temperature is further raised to about 460° C., so that the softened material of the rod 27 may diffuse or spread in and below the port 2 until it closes the port 2, as shown in FIG. 14.

The blocking rod 27 is preferably of a low-melting glass material having a softening point which is higher than that of the glass 6, so that the rod 27 may not soften before the assembly as shown in FIG. 13 is obtained. The process as illustrated in FIGS. 11 to 14 has the advantage that not only the evacuation of the enclosure and its filling with the discharge gas, but also the joining of the panel members along the edges thereof and the closing of the port can be accomplished in a single tank.

Whichever of the two processes as hereinabove described may be employed, the blocking material 27 is a simple rod having a diameter which is smaller along its entire length than that of the port 2, as is obvious from the drawings. As a result, the softened material 27 spreads only to an area which is slightly larger in diameter than the port 2, as shown in FIG. 10 or 14. As the port 2 is usually formed by drilling, however, it is often the case that the back panel member 1 has a roughened surface around the port 2. If it is too rough, the blocking material 27 as shown in FIG. 10 or 14 fails to make a complete seal against the leakage of the discharge gas. In this connection, it is desirable to cause the softened blocking material to spread to a greater extent into the space defined between the back and front panel members 1 and 3 and thereby form a gas-tight seal on a smooth surface.

Figure 15:
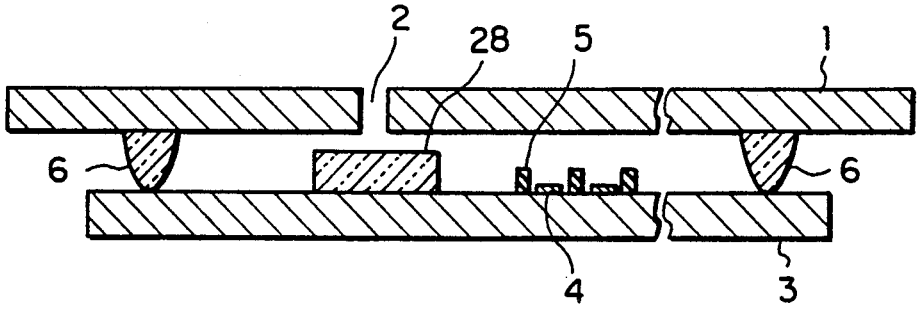
FIGS. 15 and 16 are views illustrating a process according to still another embodiment of this invention.
Figure 16:
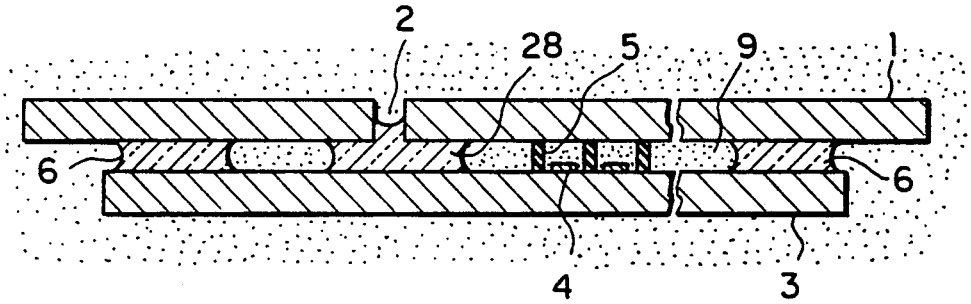

Another modification of the process according to this invention is, therefore, shown in FIGS. 15 and 16. This modification is characterized by employing a blocking member in the form of a tablet 28 carried on the inner surface of a front panel member 3 and having a diameter which is larger than that of a gas port 2, and a thickness which is equal to, or larger than, the height of insulating partitions 5, as shown in FIG. 15. Two panel members 1 and 3 are put together in the vacuum tank 21. The vacuum tank 21 is evacuated and the panel members 1 and 3 are degassed by heating at a temperature of about 350° C. At this level of temperature, glass 6 remains hard and keeps the back and front panel members 1 and 3 at the initial distance from each other. As the insulating partitions 5 are still spaced apart from the back panel member 1, the enclosure defined between the panel members 1 and 3 has a higher conductance and can be degassed and evacuated more efficiently than when the partitions 5 contact the back panel member 1. When a vacuum degree of $10^{-7}$ torr has been reached, the evacuation is discontinued and a discharge gas is introduced into the tank 21 to fill the enclosure.

Then, the temperature is raised to 450° C. to soften the glass 6. The softened glass 6 is deformed or flattened by the weight of the back panel member 1 or an external force applied to it, and the back and front panel members 1 and 3 have a smaller distance therebetween. This means a reduction in volume of the enclosure which would bring about an elevation in pressure of the discharge gas in the enclosure if it were closed. The port 2, however, remains open to allow the discharge gas to maintain a balance of pressure between the inside and outside of the enclosure until the back panel member 1 contacts the blocking tablet 28.

The softened glass 6 is eventually deformed until the back panel member 1 contacts the tablet 28. The tablet 28 is also softened by exposure to the temperature of 450° C. and the softened tablet 28 intimately contacts the back panel member 1 and closes the port 2, as shown in FIG. 16. The closed port 2 shuts off the flow of the discharge gas between the inside and outside of the enclosure and the back and front panel members 1 and 3 cease to reduce their distance. If the tank 21 as a whole is, then, cooled, the glass 6 and the tablet 28 solidify in their respective shapes as shown in FIG. 16. If it has been cooled to normal temperature, the assembly which has been made is removed from the tank 21 to yield a plasma display panel filled with the discharge gas.

Figure 17:
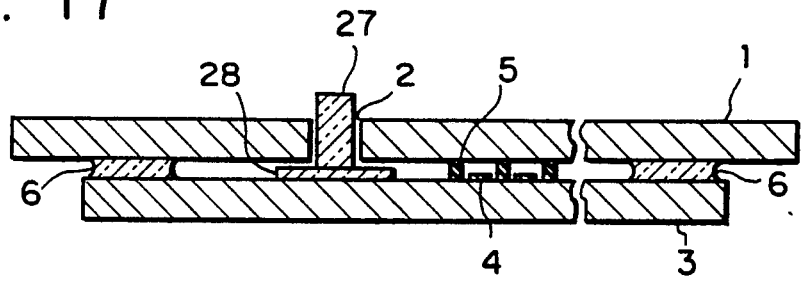
FIGS. 17 to 19 are views illustrating a process according to a further embodiment of this invention.
Figure 18:
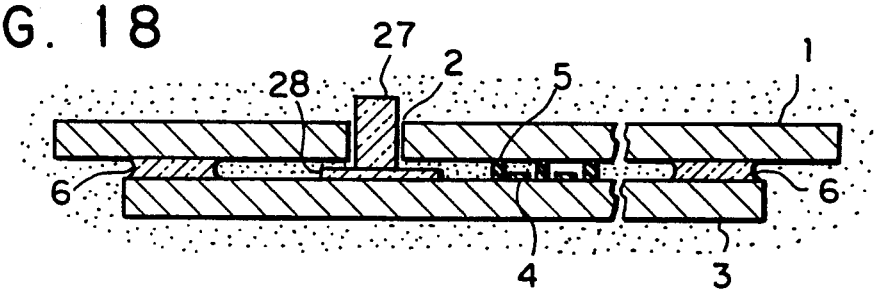
Figure 19:
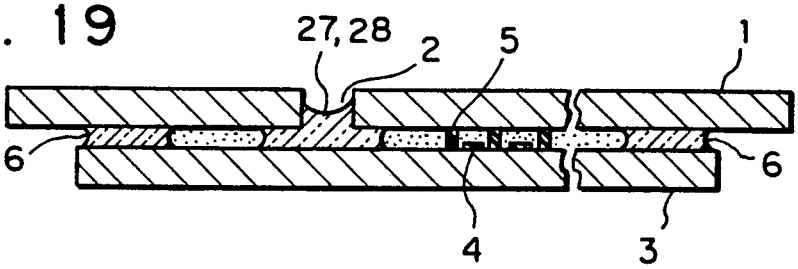

Still another modification is shown in FIGS. 17 to 19. This process is characterized by employing a blocking member which comprises a combination of a blocking rod 27 similar to that shown in FIGS. 7 to 10 and a blocking tablet 28. The tablet 28 is similar to its counterpart shown in FIG. 15 in that it has a diameter which is larger than that of a gas port 2, but differs from it in that the tablet 28 shown in FIG. 17 or 18 has a thickness which is smaller than the height of insulating partitions 5.

The tablet 28 may be a disk having a diameter of about 8 mm and a thickness of about 0.1 mm if the dimensions of the other parts and materials of a panel are as hereinbefore mentioned by way of example with reference to FIGS. 7 to 10. The tablet 28 may be formed on a front panel member 3 by printing, or otherwise. Two panel members 1 and 3 are put together in the vacuum tank 21. A discharge gas is introduced into the tank 21 to fill the enclosure defined between the two panel members 1 and 3, as shown in FIG. 18, while the whole is heated to a temperature of 350° C. Then, the temperature is raised to 460° C. to soften the rod 27 and the tablet 28, which are of the same material, so that the softened material may form a unitary mass. The softened material of the rod 27 is drawn toward the softened tablet 28 by its surface tension to close the port 2 and fill the gap existing between the back panel member 1 and the tablet 28, as shown in FIG. 19.

Referring again to FIGS. 15 and 16, it is effective to shape the blocking tablet 28 like a ring to ensure that no excess of the softened material of the tablet 28 overflow the port 2.

Although the port 2 has been described and shown as being formed in the back panel member 1, the same results of this invention can be achieved, even if it may be formed in the front panel member 3. Although the foregoing description and the drawings have been limited to the case in which only one port 2 is provided, it will sometimes be necessary or desirable to provide more than one port 2. This is particularly the case when a large plasma display panel is made. A larger enclosure defined between two panel members has a lower conductance and is more difficult to degass or fill with a discharge gas if only one port 2 is present. It is even likely that the back panel member 1 may turn about, say, a blocking tablet 28 and lie at an angle to the front panel member 3. These problems can, however, be overcome if, for example, four ports 2 and hence four blocking tablets 28 are provided adjacent to the four corners, respectively, of the panel to be assembled.

While the softened blocking tablet 28 has been described as being brought into intimate contact with the back panel member 1 by the interfacial tension therebetween, as well as the weight of the back panel member 1 or an external force applied to it, it is also effective to raise the pressure of the gas around the enclosure in the tank and thereby develop a pressure difference between the inside and outside of the enclosure to bring the two panel members 1 and 3 closer to each other with the softened blocking material 28 sandwiched therebetween.

It is likely that the softened tablet 28 may be so deformed by its own surface tension as not to close the port 2 properly. In this connection, it may be desirable to form the blocking tablet 28 with an initial thickness or height which is at least 0.1 mm larger than the distance to be defined between the two panel members 1 and 3 in the final assembly. In any such event, however, there is every likelihood that the assembly may be completed before the back panel member 1 is brought into contact with the insulating partitions 5. If such is the case, there is every possibility that the insulating partitions 5 may fail to function as such and allow abnormal crossing of a glow discharge to occur between the adjoining anodes. Even if the tablet 28 may be formed with a sufficiently large thickness, therefore, it is advisable to rely upon the pressure difference developed between the inside and outside of the enclosure, as hereinabove described, to ensure that the back panel member 1 be brought so close to the front panel member 3 as to contact the insulating partitions 5 properly.

What is claimed is:

1. A process for producing a plasma display panel comprising the steps of:

preparing a first panel member and a transparent second panel member, one of said panel members carrying a sealing material along its edge, one of said panel members having at least one port formed therethrough, while the other of said panel members carries at least one blocking member positioned to register with said port when said first and second panel members are brought adjacent to each other and having a height which is smaller than said sealing material, and which is larger than the prospective final distance between said two panel members;

placing said first and second panel members in a parallel and spaced apart relation to each other, so that said sealing material contacts the other of said panel members to define an enclosure between said panel members while said blocking member faces said port and stays within said enclosure;

evacuating said enclosure;

filling said enclosure with a discharge gas;

heating the whole structure defined by said first and second panel members and said blocking member to soften said sealing material so that said softened material joins said panel members along the edges and forms a gas-tight seal therebetween;

while softening said blocking member so that said softened member forms a gas-tight closure of said port in the first of a solidified product which has been solidified in sealing engagement with the interior surface of said one panel member surrounding said port and with the interior surface of the other of said panel members opposite the location of said port, whereby the interior surface of said one panel member surrounding said port is sealingly attached to the interior surface of the other of said panel members through said blocking member around said port.

* * * * *